US007078641B2

(12) United States Patent
Stack et al.

(10) Patent No.: US 7,078,641 B2
(45) Date of Patent: Jul. 18, 2006

(54) SWITCH CELL

(75) Inventors: John Stack, Shelby Township, MI (US); Leonard Pagano, Warren, MI (US); Jim Wright, Sterling Heights, MI (US)

(73) Assignee: Lear Corporation, Southfield, MI (US)

( * ) Notice: Subject to any disclaimer, the term of this patent is extended or adjusted under 35 U.S.C. 154(b) by 119 days.

(21) Appl. No.: 10/952,052

(22) Filed: Sep. 28, 2004

(65) Prior Publication Data

US 2006/0070866 A1 Apr. 6, 2006

(51) Int. Cl.
*H01H 9/26* (2006.01)
*H01H 15/00* (2006.01)

(52) U.S. Cl. ..... 200/553; 200/5 R; 200/16 R; 200/547

(58) Field of Classification Search ..... 200/5 R, 200/6 R–6 BA, 16 R, 16 A, 18, 547, 551, 200/553

See application file for complete search history.

(56) References Cited

U.S. PATENT DOCUMENTS

| | | | | |
|---|---|---|---|---|
| 5,243,156 | A * | 9/1993 | Shirasaka | 200/5 R |
| 5,844,182 | A * | 12/1998 | Hirano et al. | 200/5 R |
| 6,252,183 | B1 * | 6/2001 | Shirai | 200/5 R |
| 6,262,379 | B1 * | 7/2001 | Tajima | 200/5 R |
| 6,515,241 | B1 * | 2/2003 | Saiki | 200/5 R |
| 6,743,997 | B1 * | 6/2004 | Schmidt et al. | 200/553 |
| 6,841,751 | B1 * | 1/2005 | Sasaki et al. | 200/553 |

* cited by examiner

*Primary Examiner*—Michael A. Friedhofer
(74) *Attorney, Agent, or Firm*—Brooks Kushman P.C.

(57) ABSTRACT

A switch cell for use in opening and closing electrical connections, a multiple cell switch having multiple switch cells, and a method of assembling the same. The switch cell preferably includes one or more contactors in a base and an actuator slidable engaged to the base for controlling electrical connectivity by controlling movement of the contactors.

20 Claims, 4 Drawing Sheets

SWITCH CELL

BACKGROUND OF THE INVENTION

1. Field of the Invention

The present invention relates to switch cells of the type having capabilities for opening and closing one or more electrical connections.

2. Background Art

A switch cell is an electrical device for opening and closing electrical connections. In general, the switch cell includes a top portion and a bottom portion, which are commonly referred to as an actuator and a base, respectively. The base includes contactors, and in some cases, other features for establishing an electrical connection, and the actuator includes an engagement arm, and in some cases other features, for actuating the contactor, such as for opening and closing an electrical connection.

The actuator and base are in some cases separately assembly such that the two halves are joined with a snap-fit or other engagement arrangement. This can be problematic as the components, such as the contactors and engagement arm, tend to be difficult to position when assembling the two halves. As such, what is needed is an improved switch cell that ameliorates the assembly problems associated with joining the two halves of the switch cell.

SUMMARY OF THE INVENTION

One aspect of the present invention relates to a switch cell. The switch cell preferably includes an actuator slidable engaged to a base such that the actuator is slidable between a first position and a second position. Preferably, one or more electrically conducting legs and an electrically conducting contactor are positioned within the base. One or more of the legs preferably retain the conductor in the base such that the actuator may be disengaged and the base held upside down without the contactor falling through a topside of the base. In the first position, the contactor preferably contacts the first and second legs for closing a first electrical connection therebetween. Still further, an engagement portion is preferably mounted to the actuator for moving the first contactor to open the electrical connection between the first and second leg if the actuator is in the second position. In this manner, the switch cell is able to open and close electrical connections and is configured to facilitate ease of assembly as the contactors are retained within the base, such as to permit the base to be inverted without the contactors falling out therefrom.

One aspect of the present invention relates to a multiple cell switch. The switch preferably includes at least three switch cells. Each switch cell preferably includes an actuator slidable engaged to a base between a first position and a second position, electrically conducting legs positioned within the base, and electrically conducting contactors positioned within the base through an underside thereof and retained therein with at least one of the legs such that the actuators may be disengaged and the bases held upside down without the contactors falling through a topside of the base. The contactors are preferably movable by the actuator to open and close electrical connections. The switch preferably includes a 10-way positionable knob in communication with the actuators to control the opening and closing of the electrical connections.

One aspect of the present invention a method of assembling a switch cell. The method preferably includes providing a base having an underside and a topside. The topside and underside preferably each have openings with the topside opening being smaller than the bottom side opening. The method preferably includes inserting an electrically conducting contactor through the underside opening in the base and at least one electrically conducting leg through a side of the base to retain the contactor therein. The electrical contactor is preferably smaller than the underside opening and larger than the topside opening such that the actuator may be held upside down without the first contactor falling through a topside of the base. The method preferably includes engaging an actuator to the base such that the actuator is slidable moveable relative to the base for moving the contactors, the movement of the contactors controlling opening and closing of electrical connections.

DETAILED DESCRIPTION OF THE PREFERRED EMBODIMENT(S)

Figure 1:
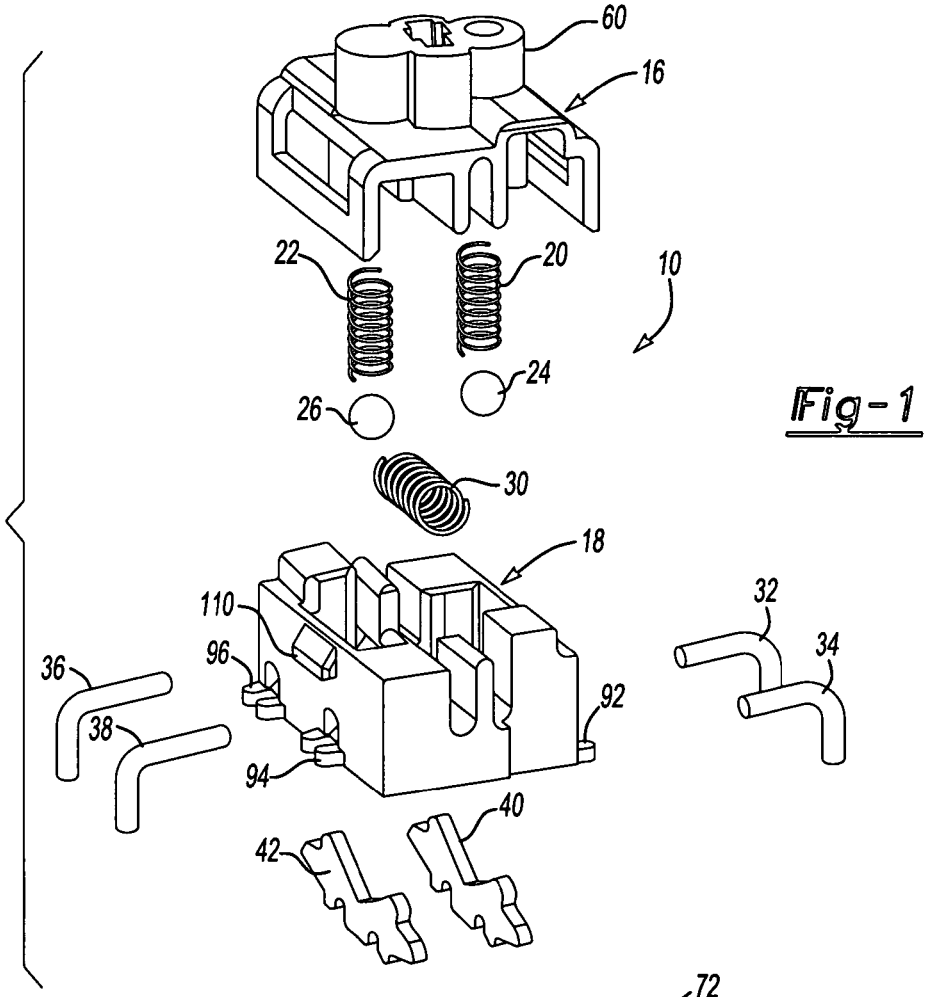
FIG. 1 illustrates an assembly view of a switch cell in accordance with one aspect of the present invention.

FIG. 1 illustrates an assembly view of a switch cell 10 in accordance with one aspect of the present invention. The switch cell 10 includes an actuator 16, a base 18, a pair of vertically orientated springs 20, 22 and ball bearings 24, 26, a horizontally orientated spring 30, a number of electrically conducting legs 32, 34, 36, 38, and a pair of electrically conducting contactors 40, 42.

In general, the contactors 40, 42 are actuated by the actuator 16 to open and close electrical connections as described below in more detail. The switch cell 10 may be used in high and low current environments where it is desirable to open and close electrical connections. The switch cell 10 is particularly advantageous in high current, DC environments where arcing and other high current phenomena may occur, such as with vehicle seating where switching of high DC current is used to control a seat positioning motor. The present invention, however, is not intended to be limited to any particular environment and contemplates that the switch cell may be used in any environment or system and may include more or less of the above-identified features.

Figure 2:
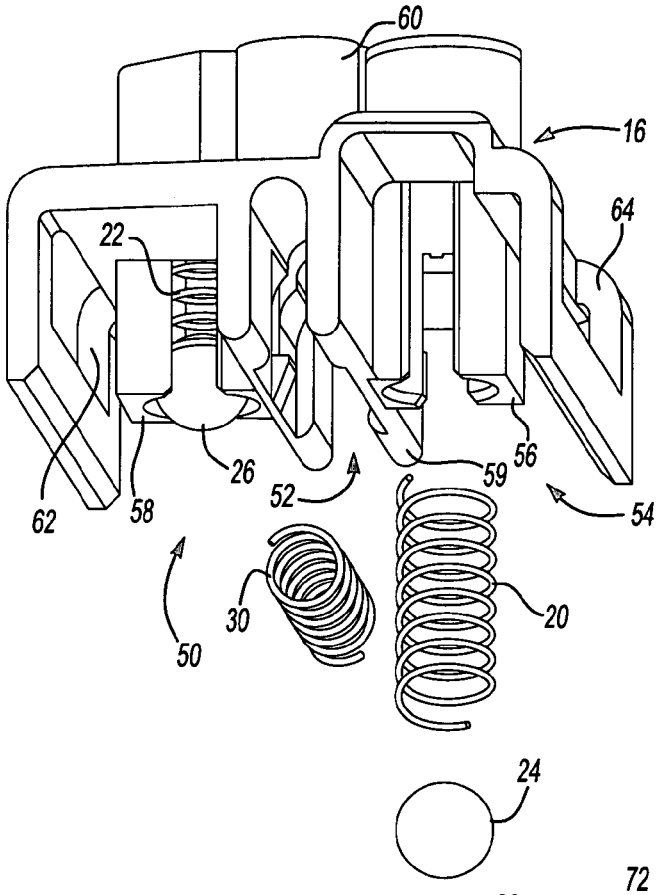
FIG. 2 illustrates an actuator in accordance with one aspect of the present invention.

FIG. 2 illustrates the actuator 16 in accordance with one aspect of the present invention. As shown, the actuator 16 includes three channels 50, 52, 54 and a pair of engagement arms 56, 58 in two of the three channels 50, 54. The engagement arms 56, 58 receive the springs 20, 22 and ball bearings 24, 26 through an underside of the actuator 16. In one aspect of the present invention, the springs 20, 22 and ball bearings 24, 26 are not retained within the engagement arms 56, 58 such that they may fall out from the underside of the actuator 16. As such, the actuator 16 is preferably flipped upside down, inverted, or rotated 180° from the right-side up orientation shown in FIG. 2, so that the springs 20, 22 and ball bearings 24, 26 may be positioned within the actuator 16 and retained therein by gravity. The present invention, however, does contemplate that a retainer or other feature may be included for retaining the springs 20, 22 and ball bearings 24, 26.

The actuator 16 may further include the horizontally aligned spring 30 in the second channel. The second channel 52 preferably includes an enlarged portion 59 for receiving the spring 30 and locating it within a central portion of the channel 52. As described below in more detail, the spring 30 biases against the base 18 to return the actuator 16 to a neutral, or first position, when force is removed therefrom.

The actuator 18 may further include a tower portion 60 and a pair of side slots 62, 64. The tower portion 60 may be used in actuation and to interact with other features connected thereto and it may include any number of shapes and features. The side slots 62, 64 combine with features on the base 18 to engage it thereto for slidable movement therewith. The length of the side slide 62, 64 defines a length of lateral movement for the actuator relative to the base.

Figure 3:
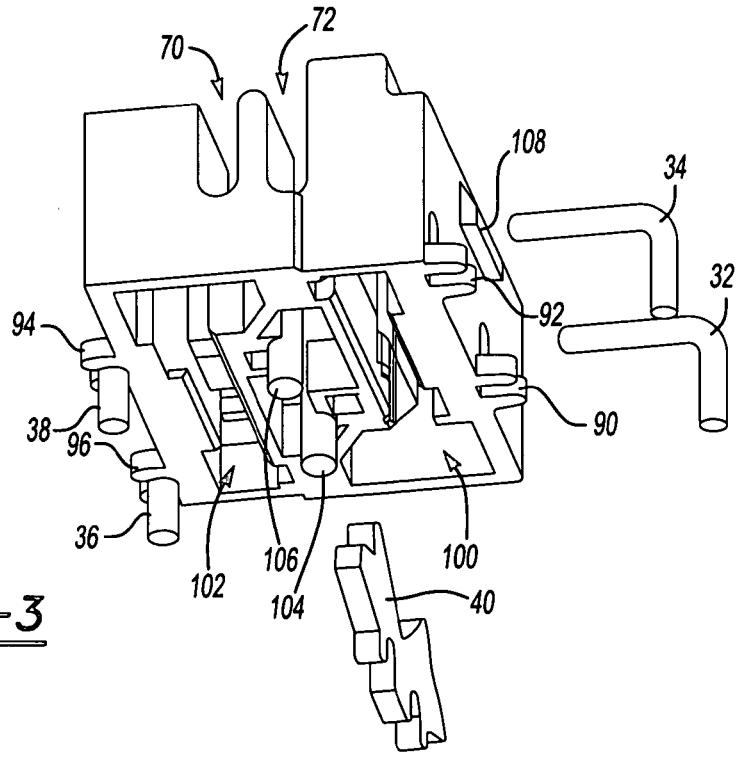
FIGS. 3 and 4 illustrate a base in accordance with one aspect of the present invention.
Figure 4:
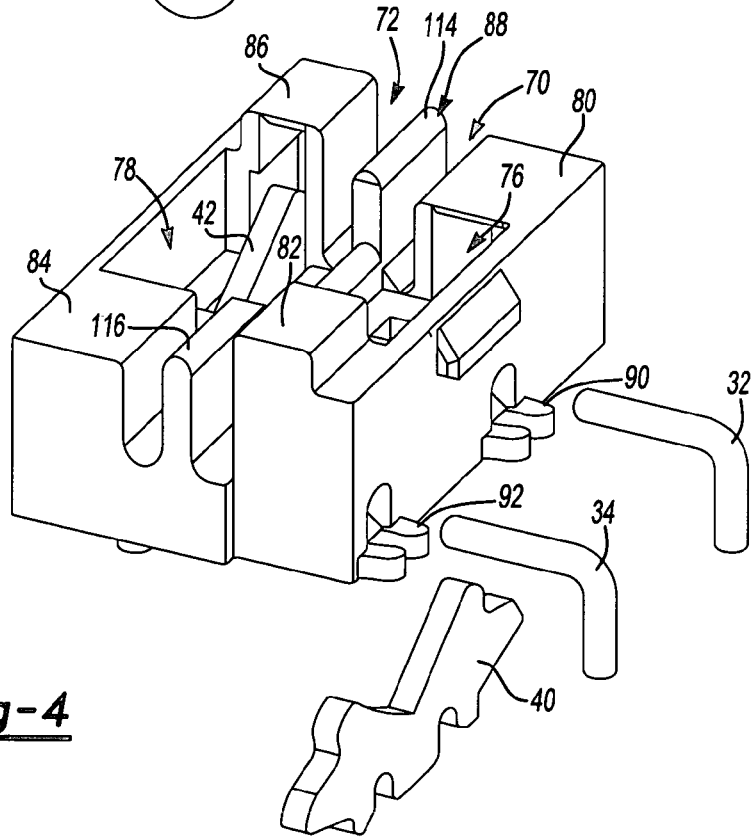

FIGS. 3 and 4 illustrate the base 18 in accordance with one aspect of the present invention. As shown, the base 18 includes a pair of channels 70, 72, a pair of openings 76, 78, a number of caps 80, 82, 84, 86, a central rail 88, and a number of snap fittings 90, 92, 94, 96. An underside of the base 18 includes a pair of openings 100, 102 and a pair of locating pins 104, 106.

The contactors 40, 42 are positioned through the openings 100, 102 in the underside of the base 18 and secured therein with the legs 32–36. In more detail, one or more contactors 40, 42 are inserted through corresponding openings 100, 102 and then one or more legs 32–36 are inserted through side openings in the base 16 and snapped thereto with the snapped fittings 90–96. A portion of the legs 32–36 project through the side openings and under the contactor 40, 42. The caps 80–86 on the topside of the base cover a portion of the openings 100, 102 shown on the underside. The combination of the legs 32–36 on the underside and the caps 80–86 of the top side retain the contactors 40, 42 within the base 18 such that the contactors 40, 42 are retained in the base 18 when it is upright, and if the base 18 is inverted, the caps 80–86 prevent the contactors 40, 42 from falling through the topside of the base 18.

Advantageously, once the one or more legs 34–36 are inserted, the contactors 40, 42 are secured within the base 18 to facilitate ease of assembly. In particular, the base 18 is assembled to the actuator 16 by turning the actuator 16 upside down, so as to prevent the springs 20, 22 and bearings 24, 26 from falling out the underside of the actuator 16, and the base 18 is turned upside down so that tabs 108, 110 on the base 18 may be inserted into the actuator slide slots 60, 62. The engagement of the base 18 and actuator 16 in this manner permits the actuator 16 to slidable engage the base 18.

The horizontally orientated spring 30 is positioned between tabs 114, 116 of the central rail 88 such that axial movement of the actuator 16 compresses the spring 30. In this manner, when force is removed, the actuator 16 returns to the first position.

Figure 5:
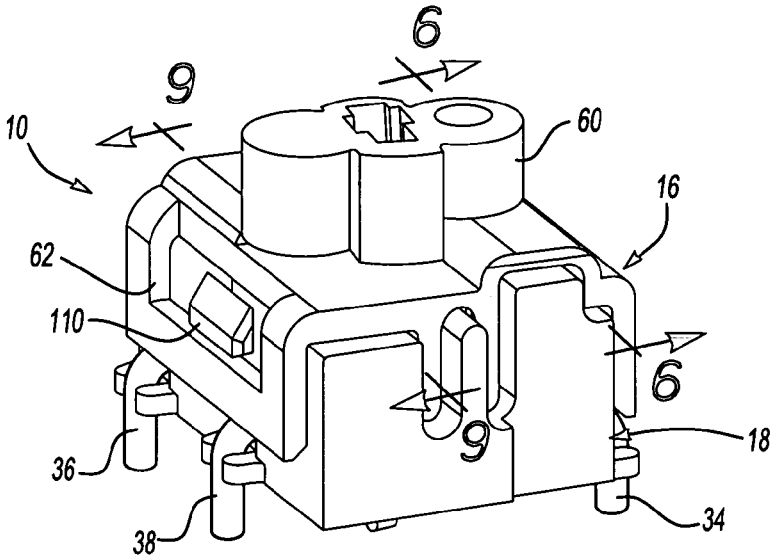
FIG. 5 illustrates the assembled switch cell in more detail.

FIG. 5 illustrates the assembled switch cell 10 in more detail. As shown, the actuator 16 covers slightly less than all of the topside of the base 18. This is advantageous because it limits the overall length of the switch cell 10, thus decreasing package and footprint size. The size of the actuator 16 may be correlated with the size of the caps 80–86 on the top side of the base 18 so that the actuator 16 may move laterally without exposing openings 76, 78 in the top side of the base 18 such that the contactors 40, 42 are protected from contaminates and other debris.

Figure 6:
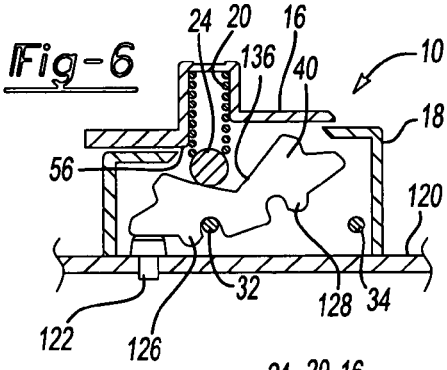
FIGS. 6–11 illustrate operation of the switch cell in accordance with one aspect of the present invention.
Figure 7:
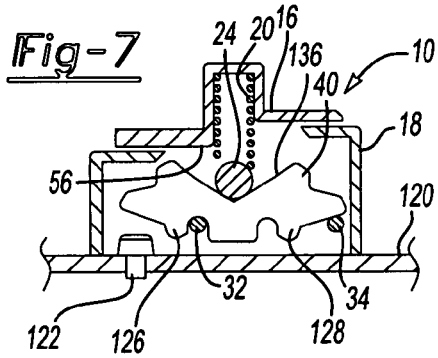
Figure 8:
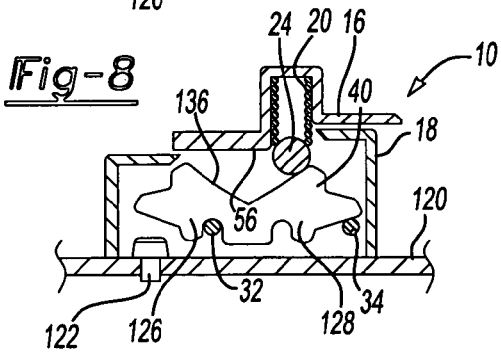
Figure 9:
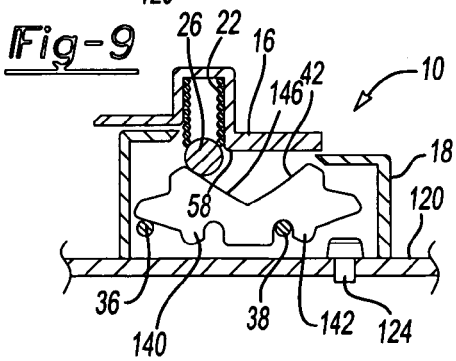
Figure 10:
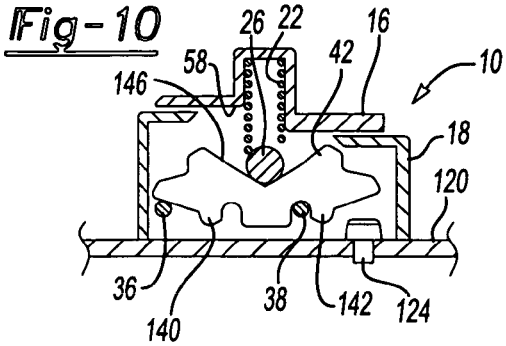
Figure 11:
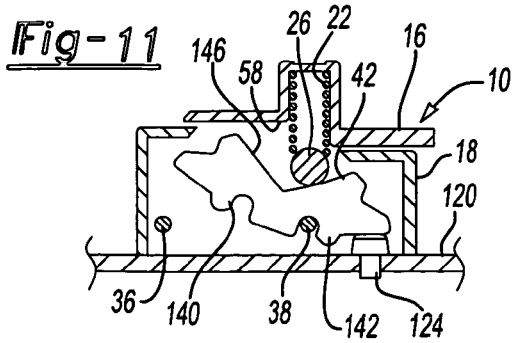

FIGS. 6–11 illustrate operation of the switch cell 10 in accordance with one aspect of the present invention. In particular, the operation of the switch cell 10 is illustrated with the switch cell being soldered to or otherwise connected to a printed circuit board (PCB) 120 having an electrically conducting legs or battery pins (B+) 122, 124. FIGS. 6–8 illustrate operation of the first contactor 40 from a cross-section view taken along line 6—6. FIGS. 9–11 illustrate operation of the second contactor 42 from a cross-section view taken along line 9—9.

FIG. 7 illustrates the first contactor 42 with the actuator 16 in a first position. In this position, a first side 126 and a second side 128 of a bottom edge of the contactor 42 rests on the first and second legs 32, 34 that were previously inserted into the base 18 as described above. As such, the electrical conductivity of the contactor 40 and the legs 32, 34 permit a first electrical connection to be established therebetween. As shown, the engagement arm 56 is positioned on an upper surface of a ramped profile portion 136 of the contactor. This first position is preferably a resting position of the actuator 16 to which the spring 30 returns it to when no force is applied thereto.

FIG. 10 illustrates the second contactor 42 with the actuator 16 in the first position. In this position, a first side 140 and a second side 142 of a bottom edge of the contactor 42 rests on the third and fourth legs 36, 38 that were previously inserted into the base 18 as described above. As such, the electrical conductivity of the contactor 42 and the legs 36, 38 permits a second electrical connection to be established therebetween. As shown, the engagement arm 58 is positioned on an upper surface of a ramped profile portion 146 of the contactor 42.

FIG. 8 illustrates the first contactor 40 with the actuator 18 in a second position. In this position, the contactor 40 rests on the first and second legs 32, 34, and because of the positioning of the legs 32, 34, the contactor 40 maintains the first electrical connection therebetween. The spring 20 and ball bearing 24 have moved vertically with respect to FIG. 7 due to the ramped profile of the contactor 40. The caps 80, 82 protect the contactor 40 from exposure if the actuator 16 is moved to the second position, so as to limit the likelihood of contaminations and other debris from reaching the contactor 40 through the opening 76.

FIG. 11 illustrates the second contactor 42 with the actuator 16 in the second position. In this position, the contactor 42 has pivoted about the fourth leg 38 such that the second side 142 of the contactor 42 is positioned proximate a bottom portion of the base 18. Advantageously, this positioning may be used in combination with the element on the PCB 124, such a first one of the B+ pins, to establish a third electrical connection between the third pin and the B+ pin 124.

As also shown, the base 18 expands proximate the first side 140 of the contactor 42 to provide clearance for the rotating contactor 42. The spring 22 and ball bearing 26 have moved vertically with respect to FIG. 10 due to the ramped profile of the contactor 42. In particular, the caps 84, 86 protects the contactor 42 from exposure if the actuator 16 is moved to the second position, so as to limit the likelihood of contaminations and other debris from reach the contactor 42 through the opening 78.

FIG. 6 illustrates the first contactor 40 with the actuator 16 in a third position. In this position, the contactor 40 has pivoted about the first leg 32 such that the first side 126 of the contactor 40 is positioned proximate a bottom portion of the base 18. Advantageously, this positioning may be used in combination with the element 122 on the PCB, such as a second one of the B+ pins, to establish a fourth electrical connection between the first pin 32 and the B+ pin 122.

As also shown, the base 18 expands proximate the second side 128 of the contactor to provide clearance for the rotating contactor 40. The spring 20 and ball bearing 24 have moved vertically with respect to FIG. 7 due to the ramped profile of the contactor 40. In particular, the caps 80, 82 protect the contactor 40 from exposure if the actuator 16 is moved to the third position, so as to limit the likelihood of contaminations and other debris from reach the contactor 40 through the opening 76.

FIG. 9 illustrates the second contactor 42 with the actuator 16 in the third position. In this position, the contactor 42 rests on the third and fourth legs 36, 38, and because of the positioning of the legs 36, 38, the contactor maintains the second electrical connection therebetween. The spring 22 and ball bearing 26 have moved vertically with respect to FIG. 10 due to the ramped profile of the contactor 42. The caps 84, 86 protect the contactor 42 from exposure if the actuator 16 is moved to the third position, so as to limit the likelihood of contaminations and other debris from reaching the contactor 42 through the opening 78.

As described above, the first and second contactors 40, 42 are moveable to open and close electrical connections. In particular, the first contactor 40 is moveable to open and close an electrical connection between the first and second legs 32, 36 and another electrical connection between the first leg 32 and an element 122 on the PCB. Likewise, the second contactor 42 is moveable to open and close an electrical connection between the third and fourth legs 36, 38 and another electrical connection between the fourth leg 38 and an element 124 on the PCB. The dual contactors 40, 42 described above provide dual functionality in a single switch cell 10 in so far as only one actuator 16 is required to provide multiple connections. Of course, however, the present invention is not limited to dual contactors. Rather, more or less contactors may be included in the switch cell.

Figure 12:
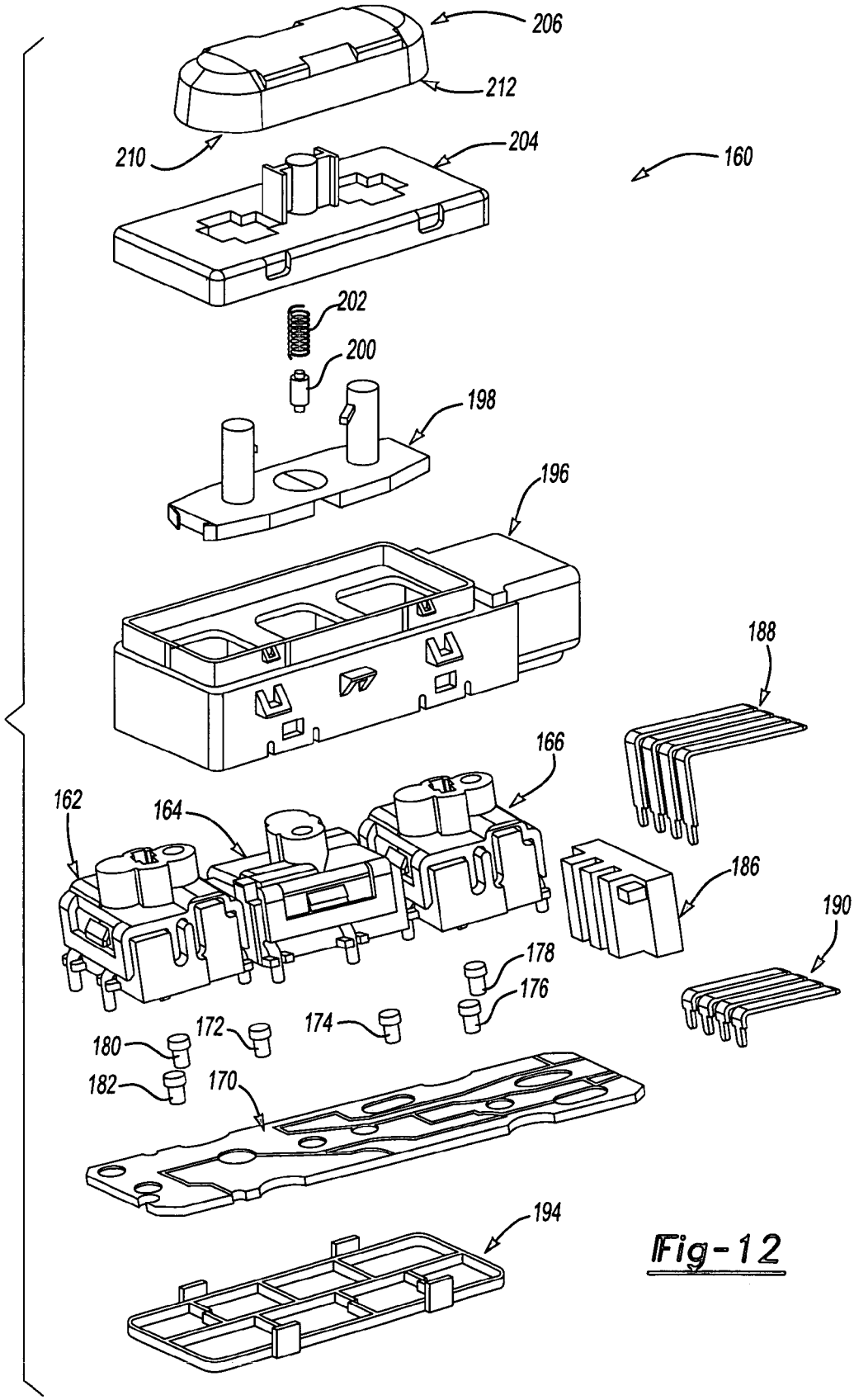
FIG. 12 illustrates a multiple cell switch in accordance with one aspect of the present invention.

FIG. 12 illustrates a multiple cell switch 160 in accordance with one aspect of the present invention. The multiple cell switch 160 includes a first 162, second 164, and third 166 switch cells, of the type described above, to open and close multiple electrical connections on a PCB 170.

In accordance with one aspect of the present invention, cells 162, 164, 166 are orientated in various configurations such that each contactor included therein may be used to provide an electrical connection with a feature on the PCB, such as a number of electrically conducting legs 172–182 shown in FIG. 10. Preferably, the multiple cell switch 160 is a seat switch for operating a seat positioning motor and the features on the PCB are battery power (B+) pins that conduct high DC current.

The multiple cell switch 160 includes an insulator 186 and a pair of blades 188, 190 connected to the PCB 170. The insulator 186 connects to a power-source or other feature (not shown) for providing electrical connection to the PCB 170 and the blades 188, 190 provide the electrical connections therewith. The multiple cell switch 160 further includes a cover 194, a housing 196, a slide plate 198, a plunger 200, a spring 202, a backplate 204, and a knob 206.

The cover 194 affixes to a bottom side of the PCB 170, such as to affix the switch 160 within a vehicle or other location. The housing 196 covers the PCB 170 and the cells 162–166 thereon, such as to protect them from damage and contamination. The slide plate 198, plunger 200, spring 202, backplate 204, and knob 206 operation cooperatively for moving the actuators on each cell. The spring 202 and plunger 200 provide a tactile feel and the knob 206 is moveable in ten directions to open and close the electrical connections of each cell.

In accordance with one aspect of the present invention, the knob 206 is moveable axially to open and close electrical connections of the second cell 164. A forward portion 210 of the knob 206 is moveable laterally to open and close electrical connections of the first cell 162. A rearward portion 212 of the knob 206 is moveable laterally to open and close electrical connections of the third cell 166. The entire knob 206, i.e. both the forward and rearward portions 210, 212, is moveable laterally to simultaneously open and close electrical connections of the first and third cells 162, 166. The knob 206 may be rotate or twisted to open and close electrical connections of the first and third cells 162, 166. In this manner, the multiple switch cell 160 provides 10-way switching functionality.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A switch cell, the switch cell comprising:

an actuator slidable engaged to a base, the actuator slidable between a first position and a second position;

first and second electrically conducting legs positioned within at least a portion of the base;

a first electrically conducting contactor positioned within at least a portion of the base through an underside thereof and retained therein with at least one of the first and second legs such that the actuator may be disengaged and the base held upside down without the first contactor falling through a topside of the base, the first contactor contacting the first and second legs in the first position for closing a first electrical connection therebetween; and an engagement portion of the actuator for moving the first contactor to open the electrical connection between the first and second leg if the actuator is in the second position.

2. The switch cell of claim 1 wherein the first contactor includes an upper edge having a ramped profile along which the engagement portion travels to pivot the first contactor with movement of the actuator from the first position to the second position, thereby opening the first electrical connection between the first and second leg.

3. The switch cell of claim 2 wherein the first contactor includes a bottom edge having a first side proximate the second leg in the first position to provide the first electrical connection between the first leg and the second leg and a second side proximate a bottom portion of the base, the ramped profile of the first contactor causing the first side to pivot away from the second leg and the second side to pivot toward the bottom portion of the base if the actuator is moved from the first position to the second position so as to open the first electrical connection between the first side and the second leg such that the second side may contact a third electrically conducting leg proximate the bottom portion of the base to provide an second electrical connection between the third and first legs.

4. The switch cell of claim 3 wherein the third leg is separate from the base, such as on a printed circuit board.

5. The switch cell of claim 1 further comprising a first spring positioned within the base and in communication with the actuator to bias the actuator to the first position such that the actuator returns to the first position from the second position if force is removed therefrom.

6. The switch cell of claim 1 wherein the engagement portion comprises a ball bearing a spring positioned within the actuator through an underside thereof such that the actuator is held upside down to retain the spring and ball bearing therein and the base is held upside down for engagement to the actuator.

7. The switch cell of claim 1 further comprising:

fourth and fifth electrically conducting legs positioned within the base; and a second electrically conducting contactor positioned within the base through an underside thereof and retained therein with at least one of the fourth and fifth legs such that the actuator may be disengaged and the base held upside down without the second contactor falling through the topside of the base, the second contactor contacting the fourth and fifth legs in the first and second positions for closing a third electrical connection therebetween.

8. The switch cell of claim 7 wherein the actuator is slidable to a third position such that in the third position the engagement portion moves the second contactor to open the third electrical connection between the fourth and fifth legs and to close the first electrical connection of the first contactor between the first and second legs.

9. The switch cell of claim 8 wherein the second contactor includes an upper edge having a ramped profile along which the engagement portion travels to pivot the second contactor with movement of the actuator from the first or second positions to the third position, thereby opening the third electrical connection between the fourth and fifth leg.

10. The switch cell of claim 9 wherein the second contactor includes a bottom edge having a first side proximate the fifth leg in the first and second positions to provide the third electrical connection between the fourth and fifth legs and a second side proximate a bottom portion of the base, the ramped profile of the second contactor causing the first side to pivot away from the fifth leg and the second side to pivot toward the bottom portion of the base if the actuator is moved from the first or second positions to the third position so as to open the third electrical connection between the first side and the fifth leg such that the second side may contact a sixth electrically conducting leg proximate the bottom portion of the base to provide a fourth electrical connection between the sixth and fourth legs.

11. The switch cell of claim 1 wherein the topside of the base includes a cap over at least a portion of the contactor to prevent the contactor from falling through the topside if the base is turned upside down when the actuator is disengaged.

12. The switch cell of claim 11 wherein the actuator covers a portion of the topside of the base between the cap and the contactor to limit particulates from contaminating the contactors.

13. The switch cell of claim 12 wherein the actuator is sufficiently sized to cover the contactor in the first and second positions.

14. A multiple cell switch, the switch comprising:

at least three switch cells, each switch cell having:

an actuator slidable engaged to a base, the actuator slidable between a first position and a second position;

electrically conducting legs positioned within at least a portion of the base; and electrically conducting contactors positioned within the base through an underside thereof and retained therein with at least one of the legs such that the actuators may be disengaged and the bases held upside down without the contactors falling through a topside of the base, the contactors movable by the actuator to open and close electrical connections; and a 10-way positionable knob in communication with the actuators to control the opening and closing of the electrical connections.

15. The switch of claim 14 wherein each contactor pivots about one of the legs that retains the contactors in the base such that pivoting controls the opening and closing of the electrical connections.

16. The switch of claim 14 wherein a topside of the bases includes a cap over at least a portion of the contactor to prevent the contactor from falling through the topside if the base is turned upside down when the actuator is disengaged.

17. The switch of claim 14 wherein each cell is mounted on a printed circuit board and each cell includes four electrically conducting legs for conducting with the printed circuit board and the printed circuit board includes two electrically conducting features for conducting with the contactors of each cell if the contactors are pivot to a position proximate a bottom side of each base.

18. A method of assembling a switch cell, the method comprising:

providing a base, the base having an underside and a topside each having an opening, the topside opening being smaller than the bottom side opening;

inserting an electrically conducting contactor through the underside opening in the base, the electrical conductor smaller than the underside opening and larger than the topside opening;

inserting at least one electrically conducting leg through a side of the base to retain the contactor therein with at least one of the first and second legs such that the actuator may be held upside down without the first contactor falling through a topside of the base; and engaging an actuator to the base such that the actuator is slidable moveable relative to the base for moving the contactors, the movement of the contactors controlling opening and closing of electrical connections.

19. The method of claim 18 further comprising inserting a spring and ball bearing through an underside of the actuator, the spring and ball bearing being in communication with the contactor when the actuator is engage to control movement of the contactors, the spring and ball bearing being unrestrained in the actuator such that spring and ball bearing fall from the underside of the actuator if the actuator is held upright.

20. The method of claim 18 further comprising inverting the actuator after insertion of the spring and ball bearing to retain the spring and ball bearing therein and inverting the base such that the base and actuator are engaged in the inverted positions.

* * * * *